US006502524B1

(12) United States Patent
Hooper

(10) Patent No.: US 6,502,524 B1
(45) Date of Patent: Jan. 7, 2003

(54) TURRET SUPPORT SYSTEM AND BEARING UNIT

(75) Inventor: Alan Gregory Hooper, Singapore (SG)

(73) Assignee: Prosafe Production PTE Ltd., The Synergy (SI)

( * ) Notice: Subject to any disclaimer, the term of this patent is extended or adjusted under 35 U.S.C. 154(b) by 32 days.

(21) Appl. No.: 09/685,036

(22) Filed: Oct. 10, 2000

(51) Int. Cl.[7] ..... B63B 21/00
(52) U.S. Cl. ..... 114/230.12
(58) Field of Search ..... 114/230.1, 230.12, 114/293; 384/12, 99, 100, 105, 107, 111, 121, 161

(56) References Cited

U.S. PATENT DOCUMENTS 3,598,369 A * 8/1971 Yielding ..... 254/106
3,782,789 A 1/1974 Koester et al.
3,799,628 A * 3/1974 Van Gaasbeek et al. ..... 384/12
3,806,975 A 4/1974 Fyfe
3,934,295 A 1/1976 Koster et al.
3,971,598 A 7/1976 Rudge
3,994,540 A * 11/1976 Petersen ..... 384/12
3,995,915 A 12/1976 Koster et al.
4,006,505 A 2/1977 Koster et al.
4,099,802 A * 7/1978 Heinemenn et al. ..... 384/122
4,200,341 A 4/1980 Kauschke
4,544,285 A * 10/1985 Shapiro et al. ..... 384/99
4,601,252 A * 7/1986 Wuttudal ..... 114/230.12
4,610,431 A 9/1986 Andrae et al.
4,610,486 A 9/1986 Baigent
4,647,253 A * 3/1987 Jacobson et al. ..... 405/168.1
4,749,282 A 6/1988 Spargo et al.
4,753,553 A * 6/1988 Carlsen et al. ..... 405/195.1
4,892,417 A 1/1990 Spargo et al.
4,928,339 A 5/1990 Klawe
5,051,035 A * 9/1991 Glorstad ..... 405/195.1
5,071,261 A 12/1991 Stuve
5,228,378 A 7/1993 Bathory
5,356,321 A 10/1994 Boatman et al.
5,466,068 A 11/1995 Andra
5,515,804 A * 5/1996 Pollack ..... 114/230.12
5,597,240 A 1/1997 Fyfe
5,762,017 A 6/1998 Groves
5,782,197 A 7/1998 Pollack
5,913,279 A 6/1999 Braud
5,957,076 A 9/1999 Pollock
6,014,939 A * 1/2000 Gusmeri et al. ..... 114/230.12
6,017,168 A * 1/2000 Fraser, Jr. et al. ..... 405/224.4
6,164,233 A * 12/2000 Pollack et al. ..... 114/230.12

* cited by examiner

*Primary Examiner*—S. Joseph Morano
*Assistant Examiner*—Ajay Vasudeva
(74) *Attorney, Agent, or Firm*—Jones, Tullar & Cooper PC

(57) ABSTRACT

The invention is a bearing unit and bearing system for supporting a large rotatable element, such as a mooring turret. The bearing unit includes a hydrostatic suspension system which enables the bearing unit to accommodate fabrication tolerances and also enables the bearing unit to conform to relative movements between the ship and the turret, thereby providing a compliant bearing system. The system includes multiple bearing units of the invention which serve as thrust and/or radial bearings for supporting the turret. By manifolding a plurality of bearing units together in a fluidly-isolated group, the pressure applied to the bearing units in that group is self-equalizing so that all the bearing units act in unison to equally support the load, while also allowing some degree of self-alignment and tilting of the load. As a result, the bearing system emulates a self-aligning bearing system and is able to compensate for axial and angular misalignment. The system allows for monitoring of each bearing unit, automatic lubrication of the bearing surfaces, and in situ replacement of bearing liners should wear or damage occur while the system is in operation.

20 Claims, 8 Drawing Sheets

FIG. 3b
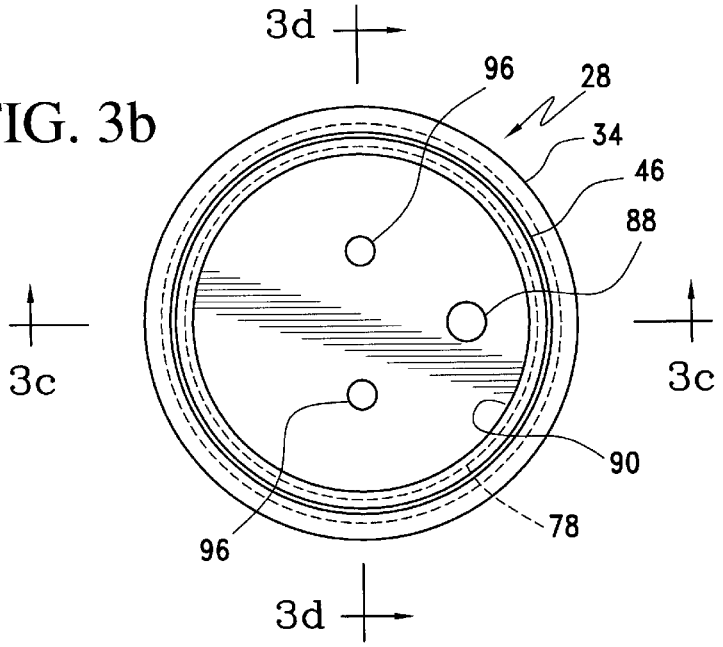
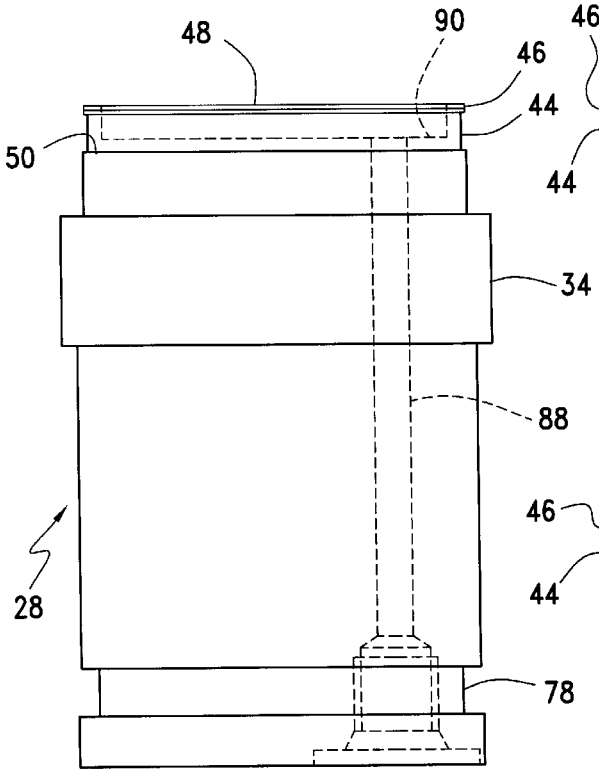
FIG. 3a
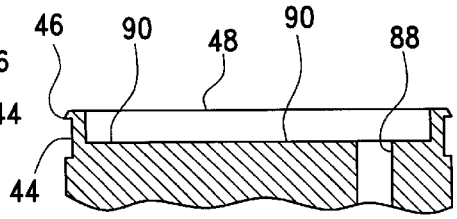
FIG. 3c
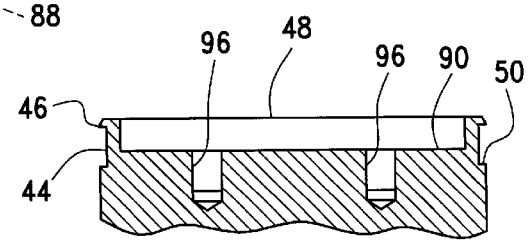
FIG. 3d

TURRET SUPPORT SYSTEM AND BEARING UNIT

BACKGROUND OF THE INVENTION

1. Field of the Invention

The present invention generally relates to offshore vessel mooring systems that include a turret rotatably mounted within an opening or well within a vessel and connectable to a seabed mooring. More particularly, the invention relates to a method and apparatus for rotatably supporting a mooring turret within a vessel hull.

2. Description of the Prior Art

In recent years, the offshore oil and gas drilling industry has gravitated away from fixed platforms and toward floating storage and production vessels. Under this arrangement, a ship, such as a retired tanker, is moored to a mooring buoy, spider, or similar device connected to the seabed at the location of an undersea well. A riser is connected from the undersea well to the ship for delivering the oil or gas product. In this manner, the ship receives the oil or gas product from the undersea well and acts as a temporary storage facility for the product.

It is desirable in open or unprotected waters to moor the ship to the mooring buoy in such a manner that the ship is free to rotate or swivel about the mooring in a practice known as weathervaning. By this method, the ship is free to move in accordance with the prevailing currents and winds, while still remaining moored to the seabed. This freedom to swivel is commonly accomplished by mounting a cylindrical mooring turret vertically within the ship in such a manner that the turret is able to rotate or swivel about a vertical axis relative to the ship. The turret is commonly moored by one or more mooring lines know as catenaries which extend to the seabed. A mooring buoy, spider, or other connection joint or platform may be used to interface between the catenaries and the bottom of the turret. In addition, one or more oil production risers extend from a wellhead on the seabed into the turret, and the output from the risers is fed into the tanks in the ship for temporary storage.

To enable rotation of the turret relative to the ship, the turret is supported within the turret enclosure by a bearing system. These bearing systems usually include at least one thrust or axial bearing system for supporting axial loads, and at least one radial bearing system for supporting radial loads. Under one conventional arrangement, a thrust bearing system and a first radial bearing system are located near the upper end of the turret, such as on the forecastle of the ship, and a second radial bearing system is located near the bottom of the turret within the turret well. However, it is also known in the art to eliminate the lower radial bearing system to reduce maintenance and alignment problems with the turret, but such an arrangement greatly increases the load and wear on the upper bearing systems. Accordingly, such single-radial-bearing arrangements require an upper bearing system that is durable and compliant.

Also, in the case of smaller ships, turrets having rigid bearing systems have been used successfully to enable the turret to rotate relative to the ship. However, in the case of large turrets, and particularly in heavy seas conditions whereby heaving of the ship may cause vessel hull deflections and substantial loads between the turret and the hull, there is a need for some bearing compliance between the turret and the vessel. Compliant bearing systems used in the past for forming an interface between the turret and the ship include spherical self-aligning bearings, compliant plane bearing systems, and crane-wheel-type bearing systems mounted on springs or rubber pads. However, there is a continuing need for improvement over the conventional turret support systems to achieve a less complex, more efficient, and more reliable support system that maintains compliancy between the turret and the ship.

SUMMARY OF THE INVENTION

Under one aspect, the present invention sets forth a novel bearing pad unit for use in the turret support system of the invention. The bearing unit includes a hydrostatic suspension system which enables the bearing unit to accommodate turret fabrication tolerances and also enables the bearing unit to conform to relative movements between the ship and the turret, thereby providing a compliant bearing system. The bearing unit includes one or more bearing plates supported by a hydrostatic load element. The turret includes a stainless steel liner or race which runs directly against the bearing plates of a plurality bearing units. One or more grease ports are provided in each bearing plate to enable the periodic application of lubricant to the interface between the bearing plates and the stainless steel bearing liner of the turret.

In each bearing unit, the hydrostatic load element supports the bearing plate or plates and allows minor realignments of the bearing plates to be made while the bearing plates are under load. The hydrostatic load element includes a bearing pad block upon which the bearing plate or plates are mounted. A cylindrical pedestal engages with a cylindrical cavity located in the bearing block for supporting the bearing block. A pressurized hydraulic fluid is disposed within the cylindrical cavity between the pedestal and the bearing block so that the block is hydrostatically supported. A primary fluid seal and a secondary fluid seal are included at the interface between the pedestal and the bearing unit to prevent leakage of the hydraulic fluid. The primary seal is the main load-bearing seal, and is essentially static in service. The secondary seal is included as a backup should the primary seal fail. Also included in the interface between the pedestal and the bearing block is an annular ring bearing which transmits side loads from the block to the pedestal so as to prevent damage to the seals and to prevent direct contact between the block and the pedestal. In addition, if hydraulic pressure is lost in a bearing unit, the bearing block will be supported by a polymer cushion located on top of the pedestal. The cushion protects the pedestal and the block from high contact stresses by preventing direct metal-to-metal contact between the block and the top of the pedestal if hydraulic pressure is lost.

Pressurized hydraulic fluid may be pumped into the cylindrical cavity to support the bearing block and to put the bearing plates in contact with the turret bearing race surface. A bleed line is included in the bearing block to enable air in the cylindrical cavity to escape when fluid is pumped into the cylindrical cavity. A fluid supply line runs through the pedestal body and the cushion so that the fluid supply line outlet opening is located on the upper end of the pedestal. The fluid supply line is connectable to the pressurized hydraulic fluid circuit, and a plurality of bearing units may be manifolded together by being placed in isolated fluid communication with each other for equalizing the pressure on each bearing unit, thereby providing a self-adjusting feature among a plurality of bearing units.

Accordingly, under an additional aspect, the invention is directed to a system for supporting a turret within a turret well or enclosure. The system includes multiple bearing pad units which serve as thrust and/or radial bearings for supporting the turret. The bearing contact elements are supported hydrostatically so as to compensate for deformations due to fabrication tolerances and vessel hull deflections under load. As a result, the bearing system emulates self-aligning bearings and is able to compensate for axial and angular misalignment. The system allows for monitoring of each bearing unit, automatic lubrication of the bearing surfaces, and in situ replacement of bearing liners should wear or damage occur while the system is in operation.

Under another aspect, the invention sets forth a novel method and apparatus for mounting and operating bearing units for supporting a turret within a turret well in a ship's hull. Under one embodiment, the thrust and radial bearings are mounted in an equally-spaced manner about the perimeter of the turret bearing surface. The thrust bearing units are all manifolded together so that hydraulic fluid is able to flow between the individual thrust bearing units, but the fluid system is otherwise isolated. Similarly, the radial bearing units are manifolded to other radial bearing units, but otherwise isolated from the fluid circuit so that fluid is able to flow between the radial bearing units, but not to the rest of the fluid circuit. By manifolding a plurality of bearing units together, the pressure applied by the bearing units is self-equalizing so that all the bearing units act in unison to equally support the load, while also allowing some degree of self-alignment and tilting of the load.

In addition, according to another embodiment, the bearing units are mounted in two or more distinct groups, and preferably three groups, with each group being centered 120 degrees apart from adjacent groups of bearing units. The bearing units in each group are manifolded together, so as to act as a single bearing support, but are not manifolded to either of the other two groups of bearing units. This results in the three distinct groups of bearing units behaving as three single bearing pads, thereby providing a self-aligning compliant support, but allowing no tilting of the load. The arrangement of this second embodiment is particularly advantageous in the case of large diameter turrets of, for example, 10 meters diameter and larger.

BRIEF DESCRIPTION OF THE DRAWINGS

The foregoing and additional objects, features, and advantages of the present invention will become apparent to those of skill in the art from a consideration of the following detailed description of the preferred embodiments of the invention, taken in conjunction with the accompanying drawings.

FIG. 3*a* illustrates an elevation view of a pedestal of the invention.

FIG. 3*b* illustrates a top view of the pedestal of FIG. 3*a*.

FIG. 3*c* illustrates a cross section view taken along line 3*c*—3*c* in FIG. 3*b*.

FIG. 3*d* illustrates a cross section view taken along line 3*d*—3*d* in FIG. 3*b*.

DETAILED DESCRIPTION

Figure 1:
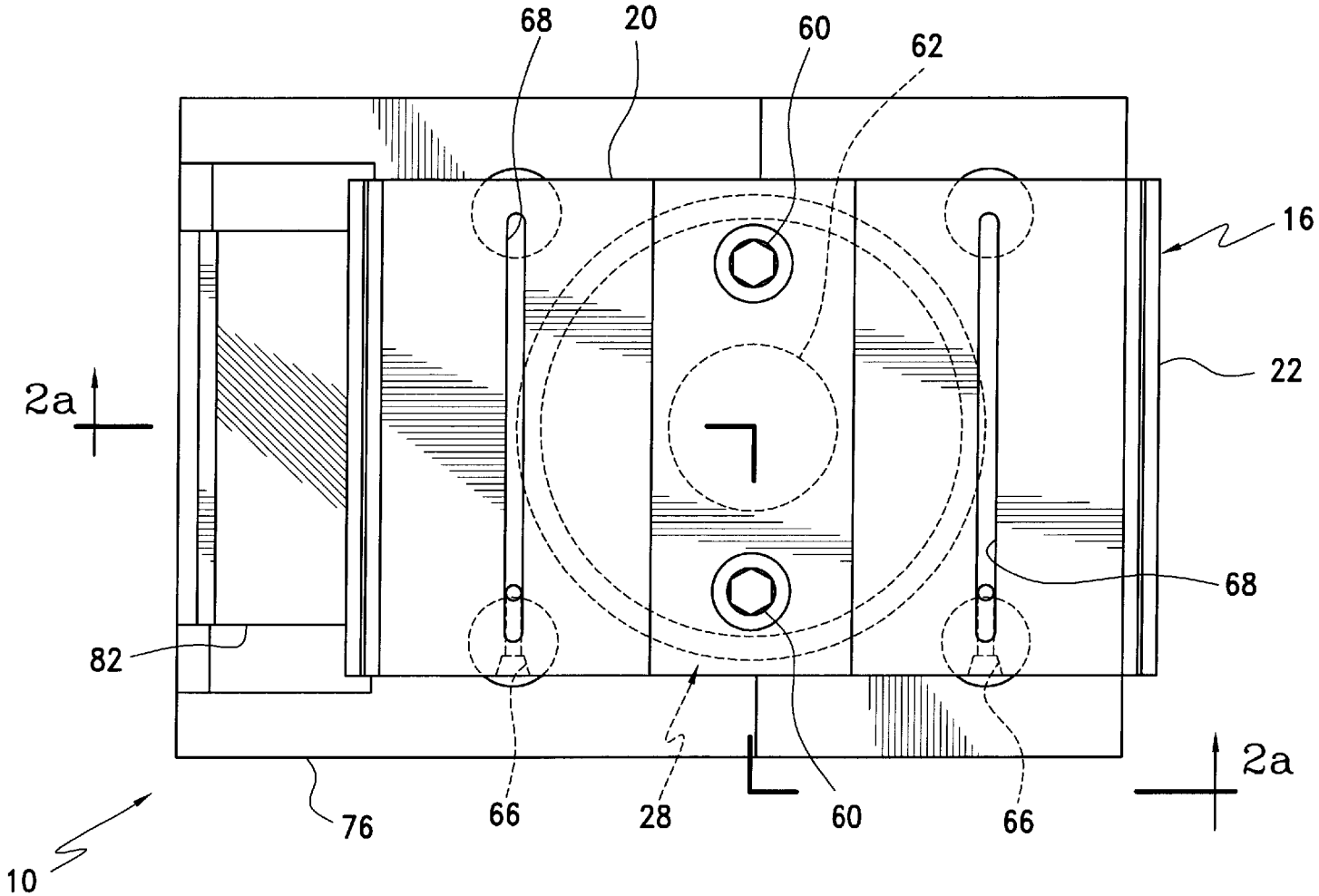
FIG. 1 illustrates a plan view of a first embodiment of a bearing unit of the invention.

The present invention sets forth a bearing system for use in supporting a large rotatable element, such as for supporting a turret within a turret well enclosure of a ship, or the like. The system includes a plurality of bearing pad units for supporting the turret. In FIGS. 1 and 2*a* there is illustrated a first preferred embodiment of a bearing pad unit 10 of the invention. In its broadest aspect, bearing unit 10 includes an outer member 12 movable relative to an inner member 14 for hydraulically supporting at least one bearing element 16 in contact with the large rotatable element (not shown in FIGS. 1 and 2*a* ). Thus, the preferred embodiment of bearing unit 10 includes a bearing block 20 as part of outer member 12 having a bearing plate 22 as bearing element 16 mounted on an upper bearing-element-support surface 24 of block 20. Bearing block 20 includes a cylindrical cavity 26 for moveable engagement with inner member 14, which is in the form of a cylindrical pedestal 28 in the preferred embodiment. Thus, bearing block 20 is axially moveable relative to pedestal 28 along the major axis of pedestal 28. By the introduction of hydraulic fluid into cylindrical cavity 26, bearing block 20 can be hydraulically supported on pedestal 28 so that bearing unit 10 is able to act essentially as a hydrostatic load element. However, as will be described in greater detail below, the fluid in bearing units 10 is not entirely static, since fluid is able to flow between two or more fluidly-connected bearing units 10 to enable bearing units 10 to adjust for load variations.

As illustrated in FIG. 2*a*, a block collar 30 is connected to the lower portion of bearing block 20. Block collar 30 includes an annular collar shoulder 32 which projects inward toward pedestal 28, and which will engage with the lower edge of an outwardly-projecting annular pedestal shoulder 34 on pedestal 28, as also illustrated in FIGS. 3*a*–3*b*. The engagement of collar shoulder 32 with pedestal shoulder 34 limits the upward movement of block 20 relative to pedestal 28 when pressurized fluid is introduced into cavity 26. Thereby, collar 30 is able to retain block 20 on pedestal 28. However, it is desirable that bearing plate 22 engage with a surface to be supported prior to the contact of collar shoulder 32 with pedestal shoulder 34. Collar 30 is secured to bearing block 20 by collar machine screws 36, or other suitable means. Collar 30, pedestal 28, block 20, and the other structural components of the invention may be constructed from stainless steel, carbon steel, cast iron, or any other suitable materials or combinations thereof, taking into account the loads to be supported and the corrosiveness of the environment of use. Furthermore, a dust seal 38 may be included in a cutout 40 located on the inner periphery of collar shoulder 32 for preventing contamination of the fluid seals and cavity 26.

Bearing unit 10 includes two fluid seals for increased reliability. A primary fluid seal 42 is located at a peripheral annular undercut 44 on pedestal 14, immediately adjacent to a lip 46 on the upper end 48 of pedestal 28. Thus, primary fluid seal 42 is retained between lip 46 and an undercut shoulder 50 formed by undercut 44. Primary fluid seal 42 is preferably a circular polymer seal having a generally V-shaped cross section, and may further include a securing O-ring 52 for added assurance. Primary seal 42 bears the full hydraulic load when bearing unit 10 is under pressure. A secondary fluid seal 54 is located in a peripheral annular recess 56 in block 20 at the interface between block 20 and block collar 30. Secondary fluid seal 54 may be of the same type and material as primary fluid seal 42, but of a slightly larger diameter. Secondary fluid seal 54 provides retention of any fluid leakage past primary fluid seal 42, and thereby contributes to the reliability of bearing unit 10.

Immediately below primary fluid seal 42 there is located a radially-acting ring bearing 58. Ring bearing 58 is located on the opposite side of pedestal shoulder 34 from block collar 30, and is constructed as a circular ring of bearing bronze, nickel-bronze alloy, or other relatively lubricious high-bearing-strength material. Ring bearing 58 is of a slightly greater diameter than pedestal shoulder 34, and absorbs and transmits lateral forces imposed on bearing block 20, thereby protecting primary fluid seal 42 and secondary fluid seal 54 from excessive wear due to side loading. Thus, side loads imposed on bearing plate 22 due to friction, or the like, are transmitted by ring bearing 58 to pedestal 28. Ring bearing 58 also prevents direct metal-to-metal contact between pedestal 28 and bearing block 20, while the relative lubricity of ring bearing 58 allows low friction axial movement of bearing block 20 relative to pedestal 28 even during side loading. In addition, block 20 and block collar 30 include lubrication ports 59 for enabling lubrication of the interface between block 20 and pedestal 28. Furthermore, it should be noted that other materials may be substituted for bronze for forming ring bearing 58, including synthetic materials. One preferred alternative material is a synthetic polymer tape of sold under the brand name Thoratape™, available from Thordon Bearings, Inc. of Canada, which may be wrapped around pedestal 28 below primary seal 42 to serve as ring bearing 58 in place of the bronze ring.

Figure 4B:
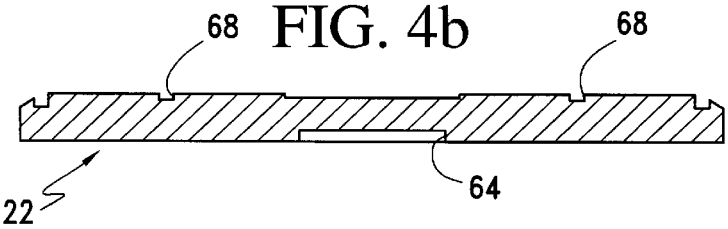
FIG. 4*b* illustrates a cross section view taken along line 4*b*—4*b* in FIG. 4*a*.
Figure 4A:
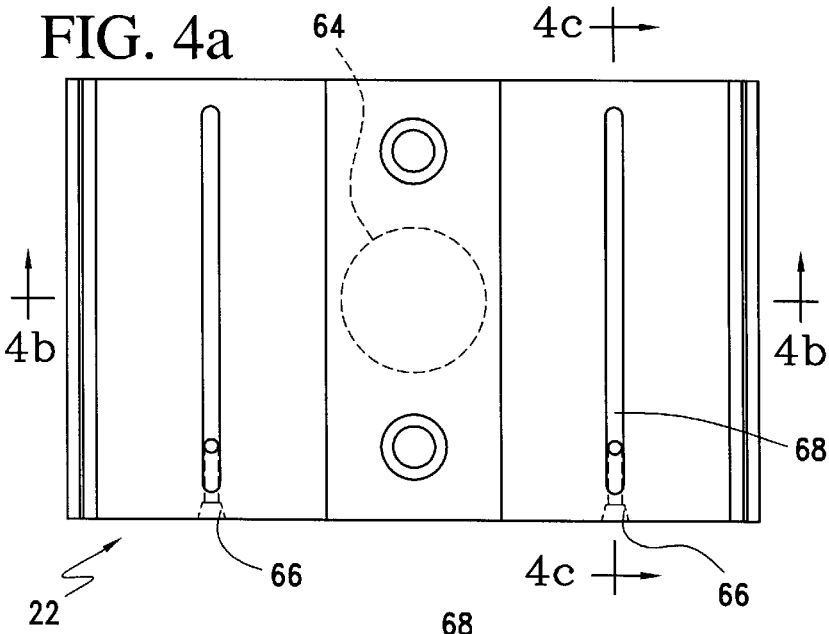
FIG. 4*a* illustrates a first embodiment of a bearing plate for use with the bearing unit of the invention illustrated in FIGS. 1 and 2*a*.
Figure 4C:
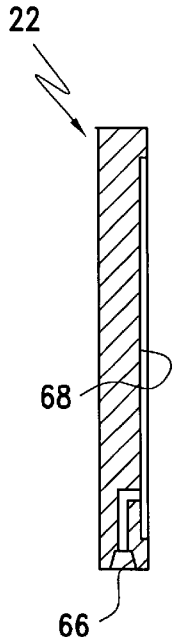
FIG. 4*c* illustrates a cross section view taken along line 4*c*—4*c* in FIG. 4*a*.

Bearing plate 22 is retained on bearing block 20 by recessed machine screws 60, as illustrated in FIG. 1. Furthermore, a circular projection 62 is centrally located on upper surface 24 of block 20 for engaging with a circular recess 64 which is centrally located in the underside of bearing plate 22. This arrangement acts to transfer lateral forces from bearing plate 22 to block 20, rather than having to rely solely on the shear strength of machine screws 60. As also illustrated in FIGS. 4*a*–4*c*, bearing plate 22 is preferably a rectangular bronze plate having a synthetic lining of low friction TRAXL bonded to its surface. TRAXL is a brand name used by Thordon Bearings, Inc. of Canada, and is a synthetic bearing lining typically applied to a bronze or stainless steel backing. Of course, the invention is not limited to a particular material or lining for the bearing plates, and any suitable material may be used for forming the bearing plates of the invention. Lubrication ports 66 are provided in bearing plate 22 to enable the periodic application of lubricant to the surface of the plate through lubrication channels 68. Application of lubricant such as grease may be accomplished manually or automatically using known systems.

Figure 2B:
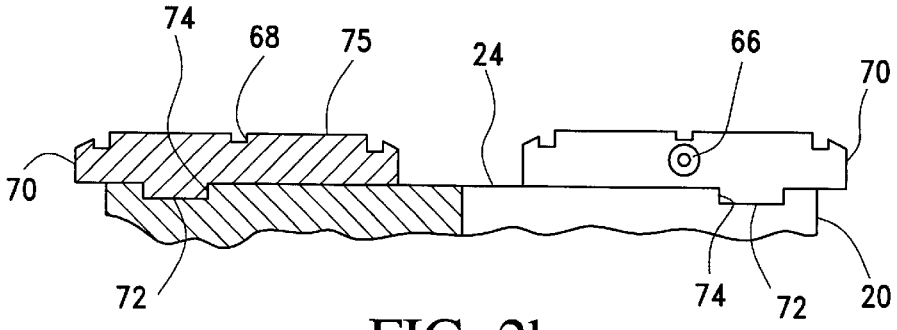
FIG. 2*b* illustrates a second embodiment of the bearing unit of FIG. 2*a*.
Figure 2A:
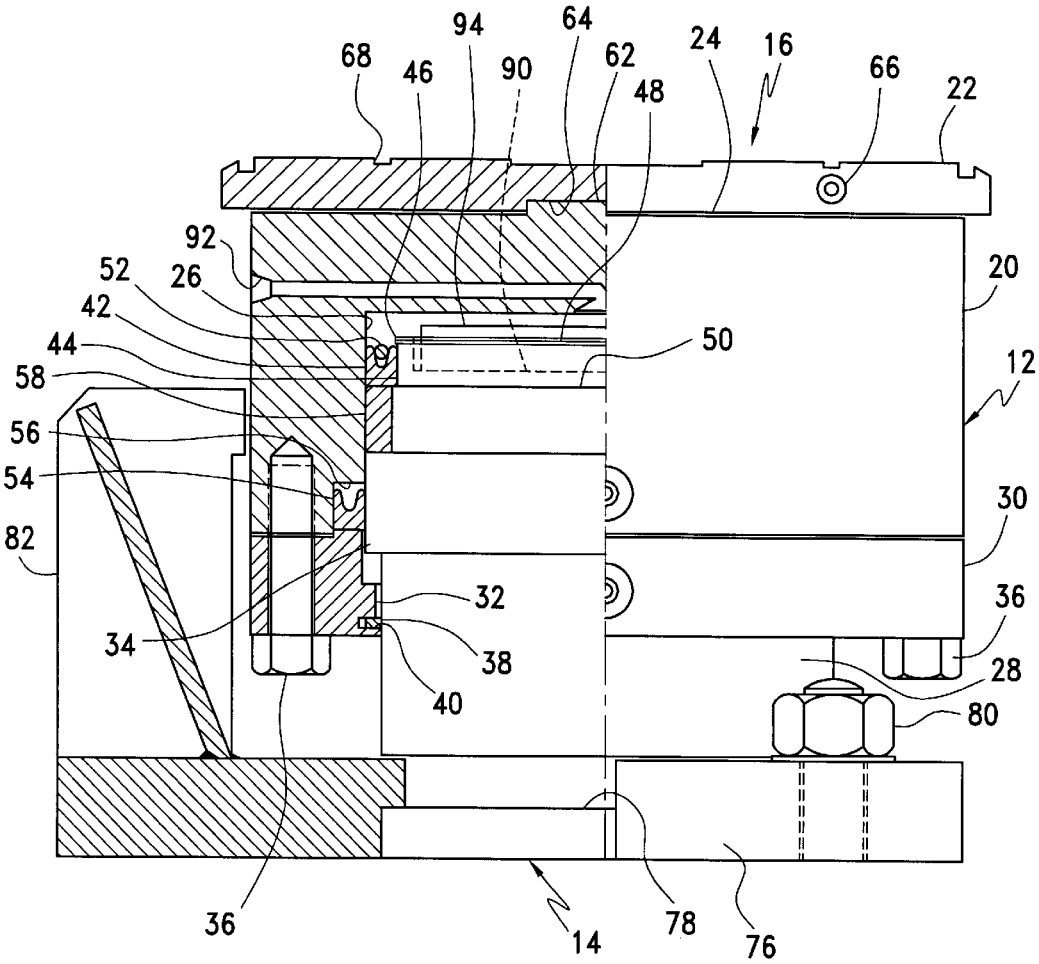
FIG 2*a* illustrates an elevation view of the bearing unit of FIG. 1, with a sectional view taken along line 2*a*—2*a* of FIG. 1.
Figure 5B:
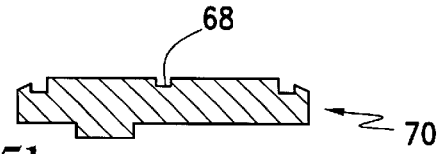
FIG. 5*b* illustrates a cross section view taken along line 5*b*—5*b* in FIG. 5*a*.
Figure 5A:
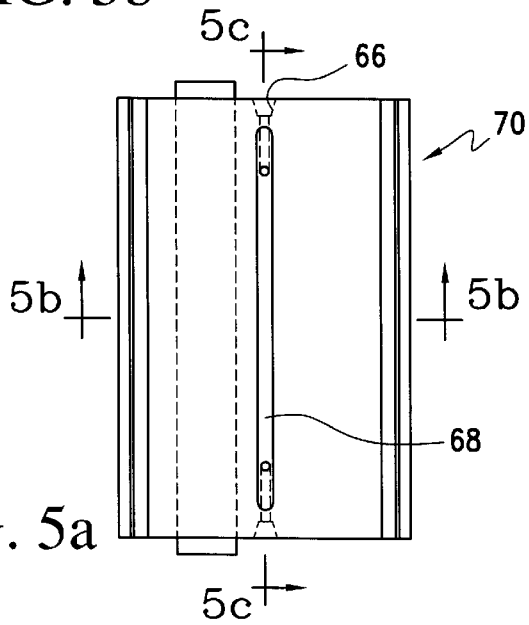
FIG. 5*a* illustrates a second embodiment of a bearing plate for use with the bearing unit of the invention illustrated in FIG. 2*b*.
Figure 5C:
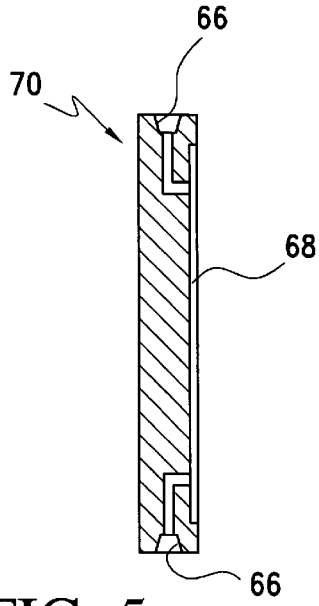
FIG. 5*c* illustrates a cross section view taken along line 5*c*—5*c* in FIG. 5*a*.

Under a second embodiment, as illustrated in FIG. 2*b*, a pair of smaller bearing plates 70 may be located on upper surface 24 of block 20 instead of single bearing plate 22. As also illustrated in FIGS. 5*a*–5*c*, bearing plates 70 include a downwardly projecting key member 72 which is used to secure bearing plates 70 to upper surface 24 of block 20. This key member 72 fits within a key slot 74 formed on upper block surface 24 and enables bearing plates 70 to be removed from bearing unit 10 for repair or replacement without necessitating access to the upper or bearing surface 75 of bearing plates 70. Accordingly, bearing plates 70 may be removed from a bearing unit 10 during use of adjacent bearing units 10, without requiring dismantling of the entire bearing unit 10. In addition, key members 72 also serve the same shear-transferring purpose as circular projection 62 and circular recess 64 in the first embodiment, and, accordingly, circular projection 62 and circular recess 64 are not required for the second embodiment. As with the first embodiment 22 of the bearing plate, bearing plates 70 may include lubrication ports 66 and channels 68, and are constructed of similar materials. In addition, lubrication ports 66 may be formed on both sides of plate 70 so that plate 70 may be interchangeably used on either end of block 20.

Referring back to FIGS. 1 and 2*a*, Pedestal 28 may be secured to a suitable support surface (not shown) by using a two-piece clamp plate 76. Clamp plate 76 annularly engages an annular groove 78 formed in the lower end of pedestal 28. Thus, clamp plate 76 encircles pedestal 28 in a collar-like manner for securely retaining pedestal 28. Clamp plate 76 may then be bolted or otherwise secured to the surface such as with bolts 80. In addition, clamp plate 76 includes a brace assembly 82 which projects upward adjacent to block 20. Brace assembly 82 is positioned so as to prevent rotation of the generally rectangular block 20. This serves to keep bearing plates 22, 70, properly oriented with respect to the bearing race of the element being supported (not shown).

Figure 6:
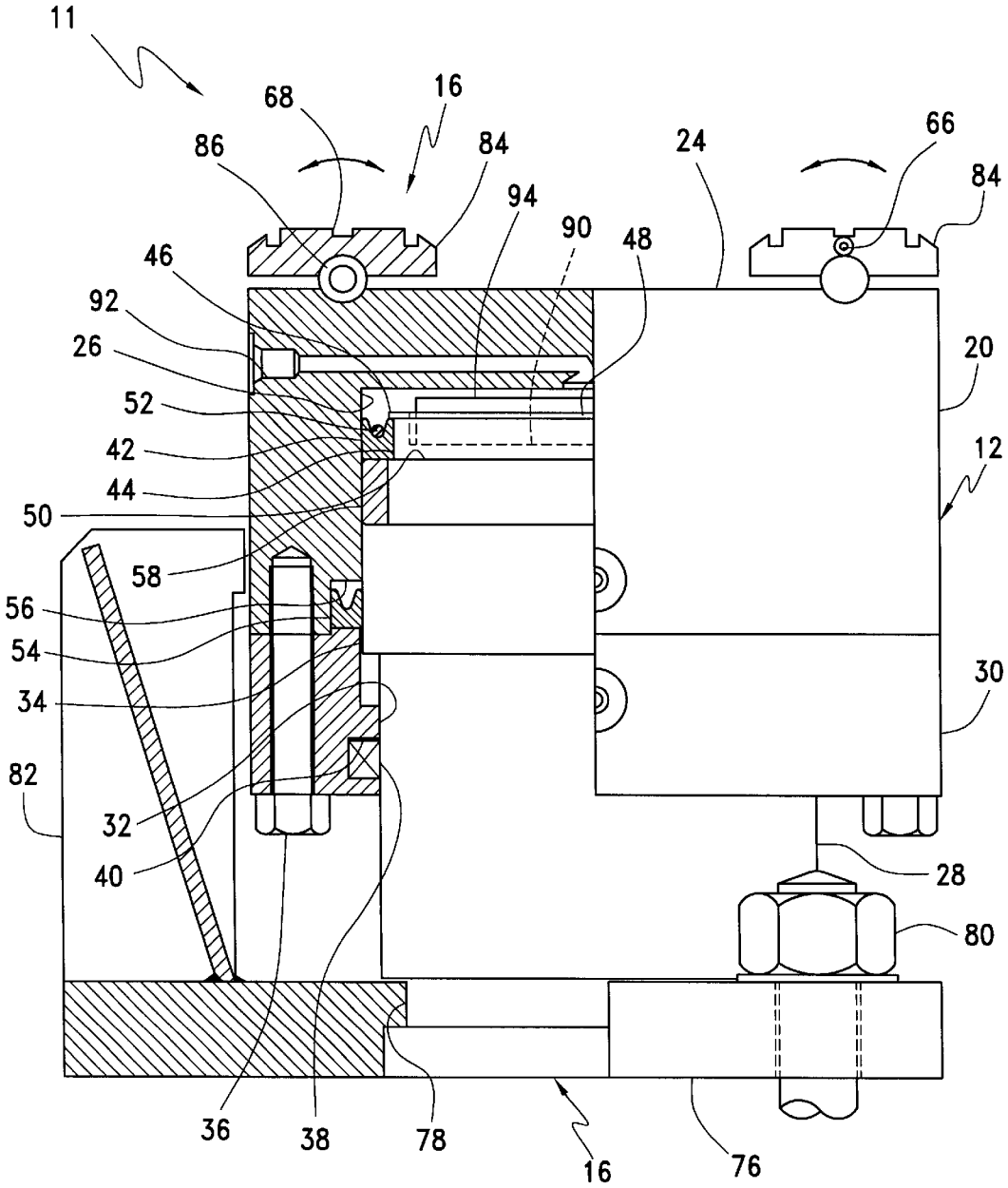
FIG. 6 illustrates a partial cross sectional elevation view of a radial bearing unit of the invention.

While the foregoing embodiments of the invention are primarily intended for use in supporting an axial load, the bearing unit of the invention may also be used as a radial bearing. Thus, in a third embodiment, as illustrated in FIG. 6, a radial bearing unit 11 includes swivelable bearing plates 84 mounted on upper surface 24 of block 20. Radial bearing unit 11 is essentially the same as bearing unit 10, with the exception of the arrangement of bearing plates 84. Swivel bearing plates 84 are able to pivot about a pivot axis 86, which enables bearing plates 84 to conform to a cylindrical (curved) bearing race (not shown) rather than a flat bearing race. This enables a plurality of radial bearing units 11 to be arranged circumferentially around the cylindrical periphery of a large rotatable element for supporting radial loads imposed on and by the rotatable element. Swivel bearing plates 84 also include lubrication ports and channels, as with the bearing plates 22, 70 of the first two embodiments, and may be similarly constructed.

As illustrated in FIGS. 3*a*–3*c*, pedestal 28 includes a main fluid port 88 for connection to a source of pressurized hydraulic fluid (not shown in FIGS. 3*a*–3*c*). Fluid port 88 runs in the direction of the primary axis of pedestal 28, and has an opening in a cylindrical depression 90 formed on the upper surface of pedestal 28. As illustrated in FIGS. 2*a* and 6, a bleed port 92 is provided in block 12 for enabling air in cylindrical cavity 26 to exit when cavity 26 is being filled with hydraulic fluid. Accordingly, pressurized hydraulic fluid may be pumped into cylindrical cavity 26 through main fluid port 88, thereby displacing air in cylindrical cavity 26 through bleed port 92. In addition, pedestal 28 may include a cushion 94 located in depression 90 on top of pedestal 28. Cushion 94 may be formed of a suitable synthetic material compatible with hydraulic fluid, such as Thorflex™, a material sold by Thordon Bearings, Inc. of Canada. Cushion 94 serves to protect pedestal 28 and block 20 from high contact stresses by preventing direct metal to metal contact between block 20 and the top 48 of pedestal 28 if hydraulic pressure is lost. Cushion 94 is mounted in depression 90 using machine screws (not shown) and screw holes 96, as illustrated in FIGS. 2*b* and 2*e*. In addition, cushion 94 includes a through-hole (not shown) which aligns with main fluid port 88 for permitting fluid to pass from main fluid port 88 into cavity 26.

Figure 7A:
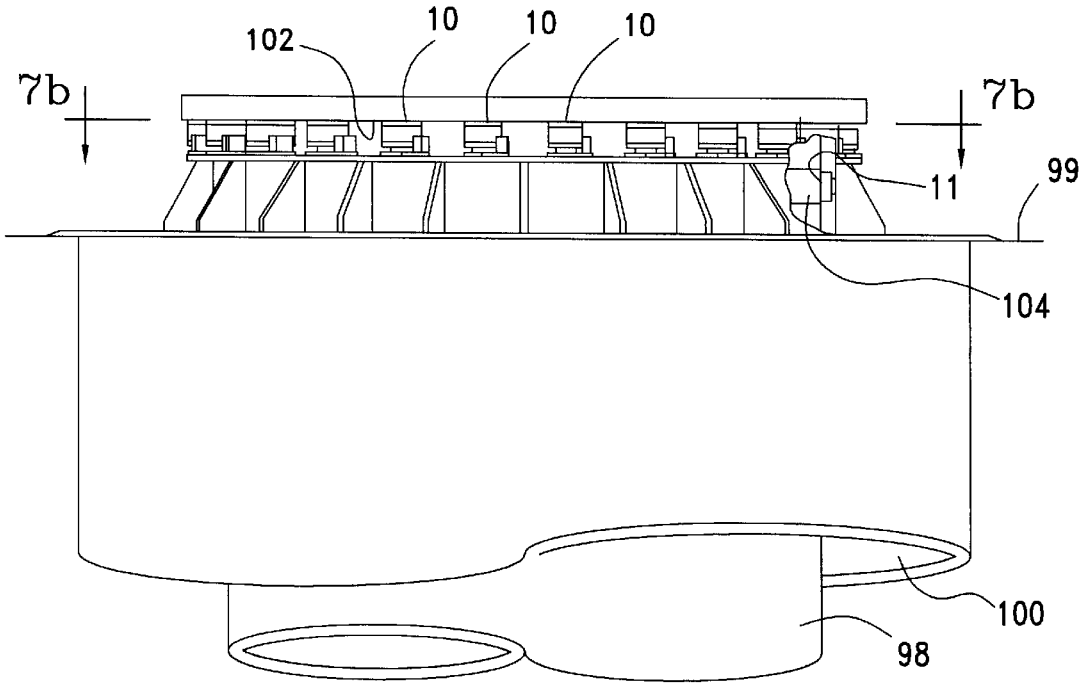
FIG. 7*a* illustrates an elevation view of a turret supported by a first embodiment of an arrangement of the bearing system of the invention.
Figure 7B:
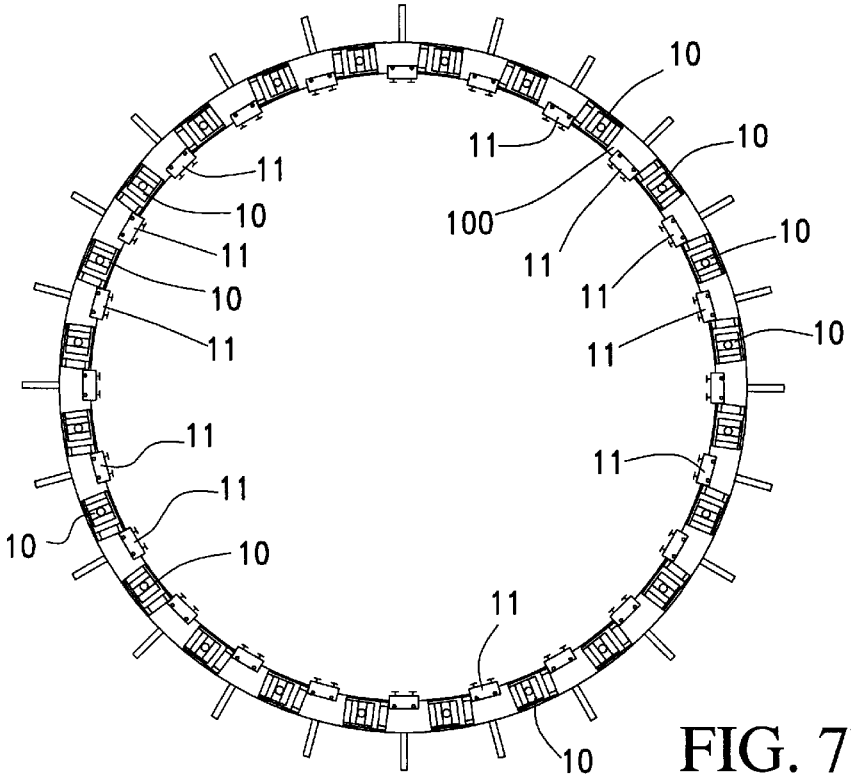
FIG. 7*b* illustrates a view taken along line 7*b*—7*b* in FIG. 7*a*.

FIGS. 7*a*–7*b* illustrate a first arrangement for mounting and operating a plurality of bearing units 10, 11 for supporting a large rotatable element, such as a mooring turret 98 mounted in the hull of a ship 99. A first set of a plurality of bearing units 10 are arranged in a radially symmetrical, equally spaced pattern for acting as thrust bearings for axially supporting turret 98. A second set of a plurality of bearing units 11 are symmetrically arranged within a turret well enclosure 100 for acting as radial bearings. Thus, the thrust bearing units 10 are in sliding contact with a first bearing race 102 located on a downward-facing flat surface located near the upper end of turret 98. A second bearing race 104 having a cylindrical configuration is provided on the outer periphery of the cylindrical surface of turret 98 for engagement with radial bearing units 11. First and second bearing races 102, 104 are preferably formed of stainless steel, although other suitable materials may also be used. It will be apparent that as turret 98 rotates about a vertical axis relative to ship 99, bearing races 102, 104 slide across bearing plates 22, 70, 84, while bearing units 10, 11 serve to maintain the spatial position of turret 98 relative to ship 99 and turret enclosure 100, and thereby prevent binding, contact, and the like.

In the embodiment illustrated in FIGS. 7*a*–7*b*, once thrust bearing units 10 are pressurized, the fluid circuit is isolated from the fluid pumping unit (not shown in FIGS. 7*a*–7*b*) and thrust bearing units 10 are all manifolded together in fluid communication so that hydraulic fluid is able to flow between the individual bearing units 10, but not back to the rest of the fluid circuit. Thus, the pressure applied by bearing units 10 is self-equalizing so that all bearing units 10 act in unison to equally support the load, while also allowing some degree of self-alignment and tilting of the load. For example, if a greater load is applied to one side of the bearing arrangement, say, due to deflections on turret 98, the bearing units 10 on the side under greater load will tend to depress under the greater pressure, and the fluid in those bearing units 10 will circulate out of those bearing units 10 and toward the bearing units 10 on the opposite side of turret 98. As the unequal load is relieved, the pressure applied to each bearing unit 10 will equalize, and, accordingly, the fluid will return to the bearing units 10 that were formerly depressed. This enables the bearing arrangement of FIGS. 7*a*–7*b* to act as a compliant, self-adjusting bearing system. Radial bearing units 11 may be similarly manifolded together in a group so that they also are compliant and self-adjusting.

Figure 8:
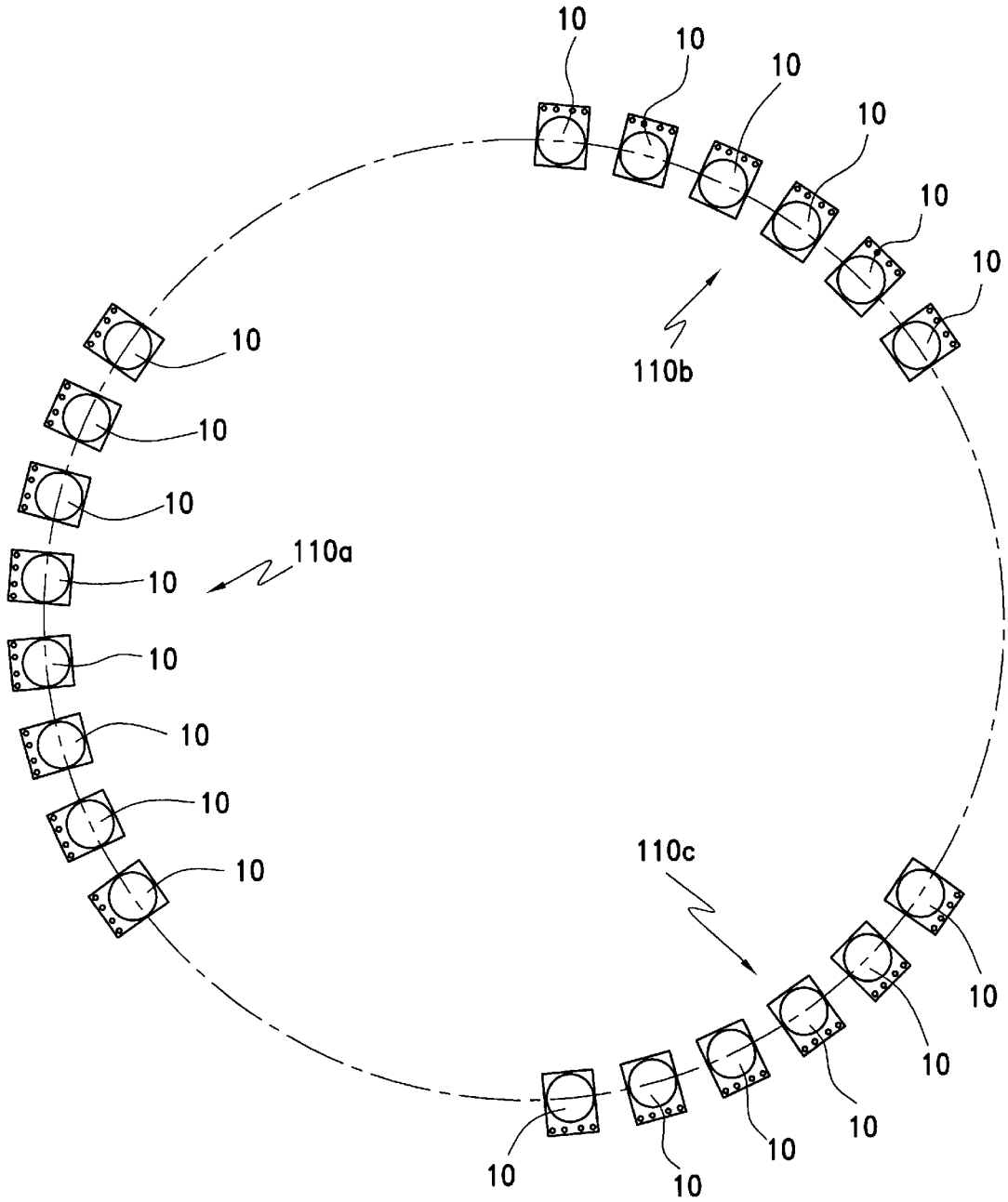
FIG. 8 illustrates a plan view of a second embodiment of an arrangement of the bearing system of the invention.

In a second embodiment, as illustrated in FIG. 8, a plurality of thrust bearing units 10 are mounted in three distinct pad groups 110*a*, 110*b*, and 110*c*, with each pad group being centered 120 degrees apart from adjacent pad groups 110*a*, 110*b*, and 110*c*. The bearing units 10 in each individual pad group 110*a*–*c* are manifolded together, so that the distinct pad group acts as a single bearing support, but are not manifolded to the bearing units 10 in either of the other two pad groups 110*a*–*c*. This results in the three groups of bearing units 10 behaving as three single bearing pads, thereby providing a self-aligning support within each pad group, but allowing no tilting of the load (in this case, turret 98). The arrangement of this second embodiment is particularly advantageous in the case of large diameter turrets of, for example, 10 meters diameter and larger.

Figure 9:
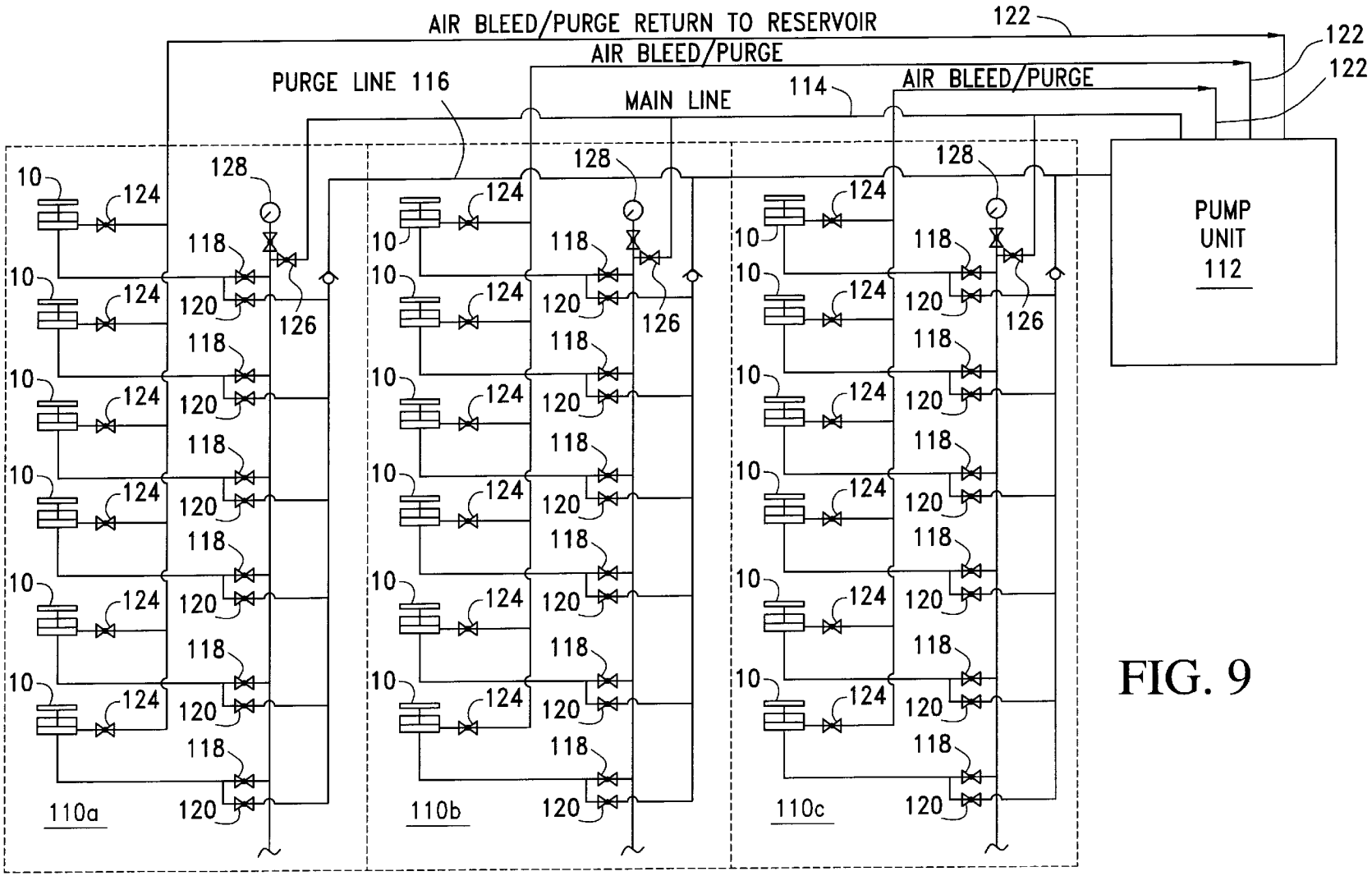
FIG. 9 illustrates a hydraulic fluid circuit for use with the bearing system of the invention.

FIG. 9 illustrates a portion of an exemplary fluid circuit of the invention that may be used with the bearing arrangement of FIG. 8. The fluid circuit of the invention includes a number of conventional components, such as a fluid sump, main pump, purge pump, accumulators, and the like, which are well known in the art, and which are illustrated schematically as pump unit 112. FIG. 9 further illustrates the fluid circuit schematic for pad groups 110*a*, 110*b*, and 110*c*. Each pad group 110*a*–*c* is connected to a main fluid line 114 and a purge/flush line 116. A main line valve 118 and a purge/flush line valve 120 are included for each bearing unit 10, so that each bearing unit 10 may be isolated, such as in the case of a bearing unit 10 requiring repair, replacement, deactivation due to fluid seal leakage, or the like. A bleed/purge fluid line 122 is also provided, and a bleed valve 124 is provided for each bearing unit 10 to enable bleeding/purging of individual bearing units 10. In addition, each pad group 110*a*–*c* includes a main line isolation valve 126. Isolation valves 126 enable each pad group 110*a*–*c* to be isolated from the pump unit 112. However, by positioning main line valves 118 in the open position and purge line valves 120 and bleed valves 124 in the closed position, each bearing unit 10 in a particular pad group 110*a*–*c* remains in fluid communication with only the other bearing units 10 in that particular pad group 110*a*–*c*, and thus, the bearing units 10 in each pad group 110*a*–*c* are manifolded to each other, but not to bearing units 10 in other pad groups 110*a*–*c*. The fluid pressure in each pad group 110*a*–*c* may be monitored by pressure gauges 128, or the like to determine that each pad group 110*a*–*c* remains properly pressurized.

In initial operation, bleed valves 124, main line valves 118, and isolation valves 126 are opened, while purge line valves 120 remain closed. Pump unit 112 is used to supply pressurized hydraulic fluid to bearing units 10. Upon bleeding of all air from bearing units 10, bleed valves 124 are closed. Bearing units 10 are then pressurized to a desired pressure so as to bring bearing plates 22, 70 into contact with first bearing race 102 and to thereby support turret 98. Isolation valves 126 are then closed so that each pad group 110*a*–*c* is isolated from the other pad groups 110*a*–*c*. However, each bearing unit 10 in a particular pad group 110*a*–*c* remains in fluid communication with the other bearing units 10 in that particular group 110*a*–*c*. Thus, each pad group 110*a*–*c* acts as a single bearing unit, while the individual bearing units 10 in the pad group 110*a*–*c* are able to compensate among themselves for misalignments, irregularities in the bearing race 102, or the like, by fluid flow between the bearing units 10 in that group. In addition, the number of bearing units 10 in each pad group 110*a*–*c* do not have to be uniform. For example, pad group 110*a* might consist of eight bearing units while pad groups 110*b* and 110*c* might only consist of six bearing units. This may be advantageous if pad group 110*a* is in line with the major axis of the ship and is subject to greater loads than pad groups 110*b* and 110*c*.

The radial bearing units 11 may also be arranged in distinct pad groups in the manner described above. In addition, it is not necessary that the pad groups be distinctly spaced from each other. For example, bearing units 10, 11 shown in the arrangement of FIGS. 8*a*–8*b* may also be manifolded into pad groups if so desired. Under one such preferred arrangement, the thrust bearing units 10 may all be manifolded together, while the radial bearing units 11 may be manifolded into groups of three or four separate pad groups. Other such manifolding combinations will also be apparent to those skilled in the art, and it is to be understood that the embodiments shown are merely exemplary.

Should it be necessary to repair or replace a bearing unit 10, (or a radial bearing unit 11) while the bearing system is in use, main line valve 118 is first closed to isolate the bearing unit 10 to be replaced from the other bearing units 10 in that group. Purge line valve 120 is then opened and purge line 116 is used to remove the fluid from that bearing unit 10, while not affecting the operation of the remaining bearing units 10. Following repair or replacement, purge line 116 is used to repressurize the repaired bearing unit 10 and the repaired bearing unit 10 is put back into fluid communication with the other bearing units 10 in its pad group 110*a*–*c* by closing purge line valve 120 and opening main line valve 118. In addition, it should be apparent that the schematic for a single pad group, for example, pad group 110*a*, represents the operation schematic for the first embodiment described above with reference to FIGS. 7*a*–7*b* in which all the bearing units 10 are manifolded together, and, accordingly, further description of the fluid circuit operation of that embodiment is not believed to be necessary.

Thus, the present invention sets forth a novel bearing unit and bearing operation system for use in supporting a large rotatable object. While the best mode of the invention has been set forth in a manner applied to a support system for a turret in an offshore mooring system, it will be apparent to those skilled in the art that other applications for the invention may also be advantageous. In addition, variations in the specific structure of the invention will also be apparent. For example, the positions of the block and the pedestal may be reversed so that the pedestal acts as a ram for supporting the bearing element. Also, other types of bearing elements might be substituted for bearing plates 22, 70, 84. For example, rollers might be mounted on top of block 20 for use as the bearing elements for contacting bearing races 102, 104. Other structural variations will also be apparent and are believed to be within the scope of the invention. Accordingly, while the foregoing disclosure sets forth exemplary embodiments of the present invention, it is to be understood that the invention is not limited to the particulars of the foregoing embodiments, but is limited in scope only as set forth in the following claims.

What is claimed:

1. An apparatus for supporting a mooring turret for rotatable movement within a turret well enclosure on a ship, said apparatus comprising:

a plurality of bearing units positioned for supporting the turret, said bearing units including an outer member having a cavity, an inner member extending into the cavity, a hydraulic fluid located within said cavity for supporting the outer member relative to the inner member, a bearing element mounted on one of said outer member or said inner member for contacting a bearing race on the turret, wherein said inner member is a fixed pedestal and said outer member is a movable block which supports said bearing element.

2. The apparatus of claim 1 in which some of said bearing units are axially oriented relative to the turret for acting as thrust bearings, while others of said bearing units are radially oriented relative to the turret for acting as radial bearings.

3. The apparatus of claim 1 further including a ring bearing mounted on said pedestal for transferring lateral loads from said block to said pedestal.

4. The apparatus of claim 1 further including a primary fluid seal and a secondary fluid seal located between said block and said pedestal for retaining the fluid within said cavity.

5. The apparatus of claim 1 wherein said bearing element comprises at least one bearing plate located on said block opposite to said pedestal for contacting a bearing race on the turret.

6. The apparatus of claim 5 wherein there are two said bearing plates and said bearing plates are pivotally mounted on said block for contacting a curved bearing race.

7. The apparatus of claim 1 further including a cushion located on the top of said pedestal for contacting said block should hydraulic pressure be lost in said cavity.

8. The apparatus of claim 1 further including a first set of fluid lines and a second set of fluid lines, said first set of fluid lines enabling fluid communication between the cavities of a first group of a plurality of said bearing units, and said second set of fluid lines enabling fluid communication between the cavities a second group of a plurality of said bearing units, whereby fluid is able to flow among the bearing units of said first group for equalizing a load, but not among the bearing units of said second group, and whereby fluid is able to flow among the bearing units of said second group for equalizing a load, but not among the bearing units of said first group.

9. An apparatus for supporting a mooring turret for rotatable movement within a turret well enclosure on a ship, said apparatus comprising:

a plurality of bearing units positioned for supporting the turret, said bearing units including;

a fixed pedestal having a major axis;

a block mounted on said pedestal for movement in a direction along the major axis of said pedestal, said block having a cavity for receiving said pedestal and a hydraulic fluid, whereby the hydraulic fluid supports said block in relation to said pedestal; and a bearing element mounted on said block opposite to said cavity for contacting a bearing race on the turret.

10. The apparatus of claim 9 in which some of said bearing units are axially oriented relative to the turret for acting as thrust bearings, while others of said bearing units are radially oriented relative to the turret for acting as radial bearings.

11. The apparatus of claim 9 further including a ring bearing mounted on said pedestal for transferring lateral loads from said block to said pedestal.

12. The apparatus of claim 9 further including a primary fluid seal and a secondary fluid seal located between said block and said pedestal for retaining the fluid within said cavity.

13. The apparatus of claim 9 wherein said bearing element comprises at least one bearing plate located on said block opposite to said pedestal for contacting a bearing race on the turret.

14. The apparatus of claim 13 wherein there are two said bearing plates and said bearing plates are pivotally mounted on said block for contacting a curved bearing race.

15. The apparatus of claim 9 further including a cushion located on the top of said pedestal for contacting said block should hydraulic pressure be lost in said cavity.

16. The apparatus of claim 9 further including a first set of fluid lines and a second set of fluid lines, said first set of fluid lines enabling fluid communication between the cavities of a first group of a plurality of said bearing units, and said second set of fluid lines enabling fluid communication between the cavities a second group of a plurality of said bearing units, whereby fluid is able to flow among the bearing units of said first group for equalizing a load, but not among the bearing units of said second group, and whereby fluid is able to flow among the bearing units of said second group for equalizing a load, but not among the bearing units of said first group.

17. An apparatus for supporting a mooring turret for rotatable movement within a turret well enclosure on a ship, said apparatus comprising:

a plurality of self-equalizing bearing units positioned for supporting the turret, said bearing units including a fixed pedestal having a major axis, a block mounted on said pedestal for movement in a direction along the major axis of said pedestal, said block having a cavity for receiving said pedestal and a hydraulic fluid, and a bearing element mounted on said block opposite to said cavity for contacting a bearing race on the turret, whereby the hydraulic fluid supports said block in relation to said pedestal, and whereby the fluid is able to flow between said bearing units for self-equalizing said bearing units.

18. The apparatus of claim 17 further including a ring bearing mounted on said pedestal for transferring lateral loads from said block to said pedestal.

19. The apparatus of claims 17 further including a primary fluid seal and a secondary fluid seal located between said block and said pedestal for retaining the fluid within said cavity.

20. The apparatus of claim 17 further including a cushion located on the top of said pedestal for contacting said block should hydraulic pressure be lost in said cavity.

* * * * *